US006736157B1

(12) United States Patent
Andersson et al.

(10) Patent No.: US 6,736,157 B1
(45) Date of Patent: May 18, 2004

(54) BLOCKING DEVICE

(75) Inventors: Lars-Inge Andersson, Halmstad (SE); Anders Rosengren, Halmstad (SE)

(73) Assignee: Malte Persson & Son AB, Halmstad (SE)

( * ) Notice: Subject to any disclaimer, the term of this patent is extended or adjusted under 35 U.S.C. 154(b) by 41 days.

(21) Appl. No.: 10/088,119

(22) PCT Filed: Sep. 14, 2000

(86) PCT No.: PCT/SE00/01780

§ 371 (c)(1),
(2), (4) Date: Mar. 15, 2002

(87) PCT Pub. No.: WO01/19721

PCT Pub. Date: Mar. 22, 2001

(30) Foreign Application Priority Data

Sep. 16, 1999 (SE) ..... 9903361
May 19, 2000 (SE) ..... 0001853

(51) Int. Cl.[7] ..... F16K 17/40; F16L 37/38; B67D 5/32

(52) U.S. Cl. ..... 137/68.14; 137/614.05; 285/2; 285/93; 285/304; 285/307; 285/321

(58) Field of Search ..... 137/68.14, 614.05; 285/1, 2, 3, 4, 93, 304, 307, 321; 141/208

(56) References Cited

U.S. PATENT DOCUMENTS 2,048,388 A * 7/1936 Johnsen
2,452,430 A * 10/1948 Clark et al.
4,465,096 A * 8/1984 Voisine ..... 137/614.04
4,691,941 A * 9/1987 Rabushka et al. ..... 285/1
4,872,471 A * 10/1989 Schneider
4,899,792 A * 2/1990 Podgers ..... 141/382
5,285,807 A * 2/1994 Nitzberg
5,564,471 A * 10/1996 Wilder et al. ..... 137/614.04
5,881,769 A * 3/1999 Hopson ..... 137/614.2

FOREIGN PATENT DOCUMENTS

EP 0 517 127 A1 * 6/1992
EP 0 555 558 A1 * 12/1992
EP 0 623 771 A2 * 3/1994

* cited by examiner

*Primary Examiner*—John Rivell
*Assistant Examiner*—Ramesh Krishnamuryhy
(74) *Attorney, Agent, or Firm*—Antonelli, Terry, Stout & Kraus, LLP

(57) ABSTRACT

The present invention relates to a device for blocking a liquid- and/or vapour-flow from a hose and positioning a hose rupture to a coupling in the hose, e.g. the end of the hose and a nozzle, the coupling comprising a female fitting (2) and a male fitting (1), each with its radial, at least partly conical portion (6, 7) which, after union of the male fitting (1) in the femal fitting (2), form at least parts of a conical ring, a split ring (10) consisting of one or more parts and provided with a groove (11) fitting the conical ring, being disposed on the conical ring (6, 7) for interconnecting and retaining the male fitting (1) in the female fitting (2), the ring (10), on the opposite side in relation to the groove (11) having at least one groove (12, 27, 28) each for a spring ring (13, 29, 30) for orientation of the string ring (13, 29, 30) and urging the ring (10) against the conical ring (6, 7) and retention of the male fitting (1) in the female fitting (2) until a predetermined separating force occurs, when the split ring (10) slides off the conical ring (6, 7) so that the retention of the male fitting (1) in the female fitting (2) ceases, a valve cone (3) being disposed to block liquid and/or vapour-flow in the event that the male fitting (1) and the female fitting (2) are parted from one another, and the valve con (3) having coupling elements (19) for engagement with the female fitting (2), and a sealing element (18) for co-operation with sealing surface in the male fitting (1), or vice versa, and an indication of fracture (21) being located between the coupling elements (19) and the sealing element (18).

9 Claims, 14 Drawing Sheets

1
5
6
7
13
16
2
14
20
16
10
22
23
24
19
17
18

2
5
16
9
7
10
4
13
1
14
3
24
23
22
19
17
18

1
2
3
4
5
6
7
8
9
10
12
13
14
16
17
18
19
22
23
24

1
18
6
7
21
22
3
24
23
19
2
16
10
9
8
13
17

19
16
10
13
1
25
3
2
7
6
26

1
29
27
10
28
30
2
19
3
4
5
6
7
16

1
4
5
6
7
16
2
19
3
21
17
13
12
18

1
18
16
21
2
10
13
19
3

42
41
24
3
19
20
35
2
16
40
10
7
30
31
29
34
32
4,5
1
33
18
36
38
39
37
17
31
21

3
19
19
2
21
37
32
1
39
36

BLOCKING DEVICE

FIELD OF INVENTION

The present invention relates to a device for blocking a liquid- and or vapour flow from a hose and positioning a hose rupture to a coupling in the hose, e.g. the end of the hose, and a nozzle.

BACKGROUND OF THE INVENTION

The number of self-service stations for fuelling vehicles is steadily increasing and the problems inherent in nozzle spouts which are left in the filler pipe of the fuel tank are steadily increasing. In most cases, a pump nozzle spout left in a filler pipe results in a hose rupture and the discharge of fuel into the ambient surroundings, with all of the hazards, to both the environment and general safety, that such an event occasions. Further, increasingly stringent environmental requirements are placed on service stations for avoiding the spillage of both liquid and vapour from the various fuels. Prior art aids for avoiding spillage in hose rupture are relatively unwieldy and display a complex design and construction, which in turn entails both a risk of unreliable operation, but above all high production costs which greatly counteract the use of such aids.

The task forming the basis of the present invention is to realise an improvement to the device disclosed by way of introduction.

SUMMARY OF INVENTION

The present invention realises a hose rupture valve with relatively slight spatial requirements without jeopardising the desired function and reliability. Moreover, the present invention makes for the manufacture and assembly of the hose rupture valve at low cost. In addition, re-use is prevented and the provision of sealing ring or sealing rings for counteracting leakage on the occurrence of powerful forces (pulsating forces) is further made possible.

BRIEF DESCRIPTION OF THE DRAWINGS

Embodiments of a device according to the present invention will now be described in greater detail hereinbelow, with reference to the accompanying Drawings.

DETAILED DESCRIPTION

The embodiments of a device according to the present invention shown on the Drawings are intended and disposed for placing in a per se conventional pump nozzle with an opening lock and a per se conventional hose end, which may be of coaxial type with a central channel for vapour recovery, and an annular channel surrounding the central channel and discrete therefrom for the liquid flow. A simplified variation of a device according to the present invention may very well be employed in such contexts where there is no vapour recovery facility. In such an event, certain parts of the device may be of somewhat simpler design and construction, as will be illustrated later in the body of this specification.

Figure 1:
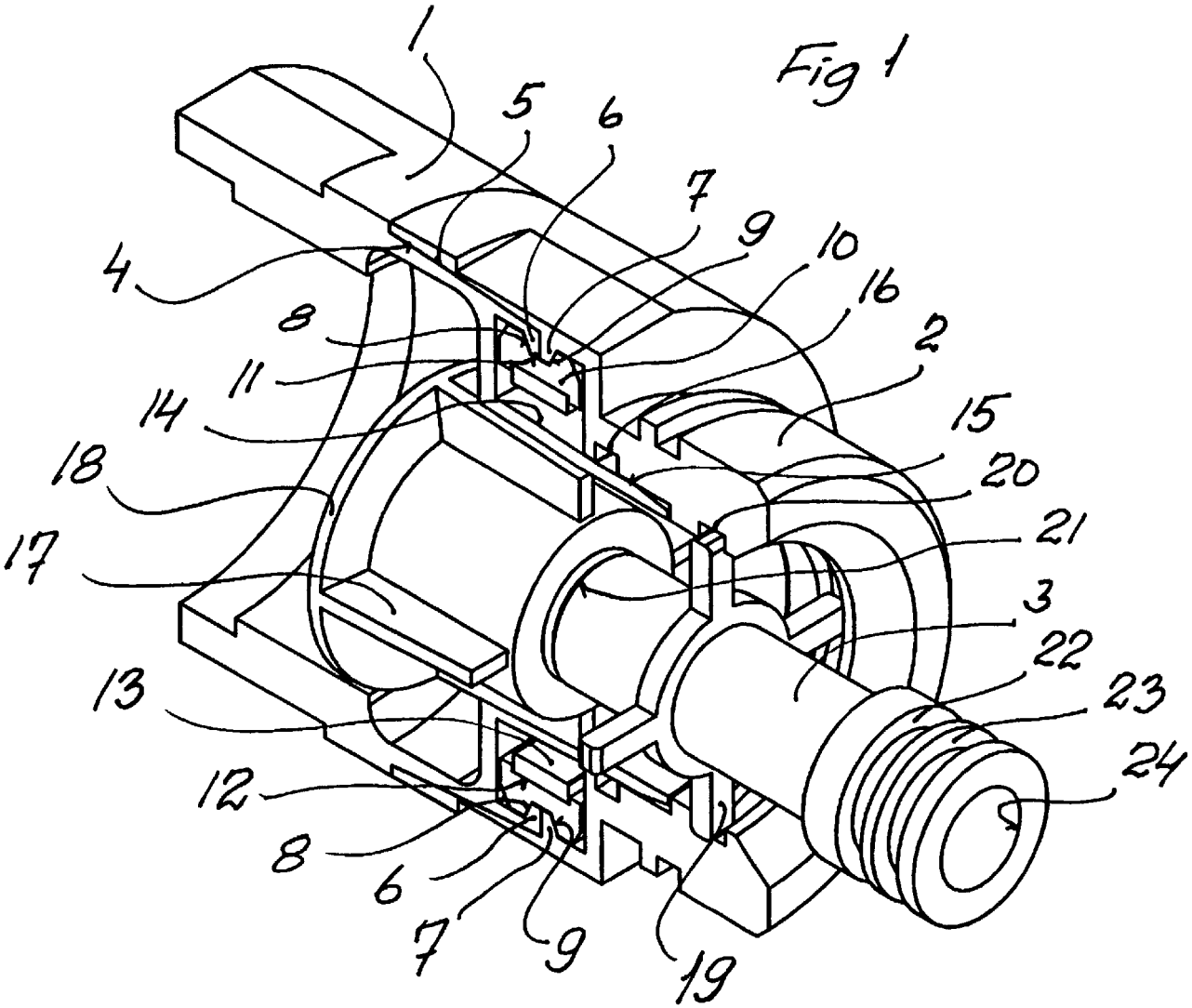
FIG. 1 is a perspective view, partly in section, of one embodiment of a device according to the present invention.
Figure 2:
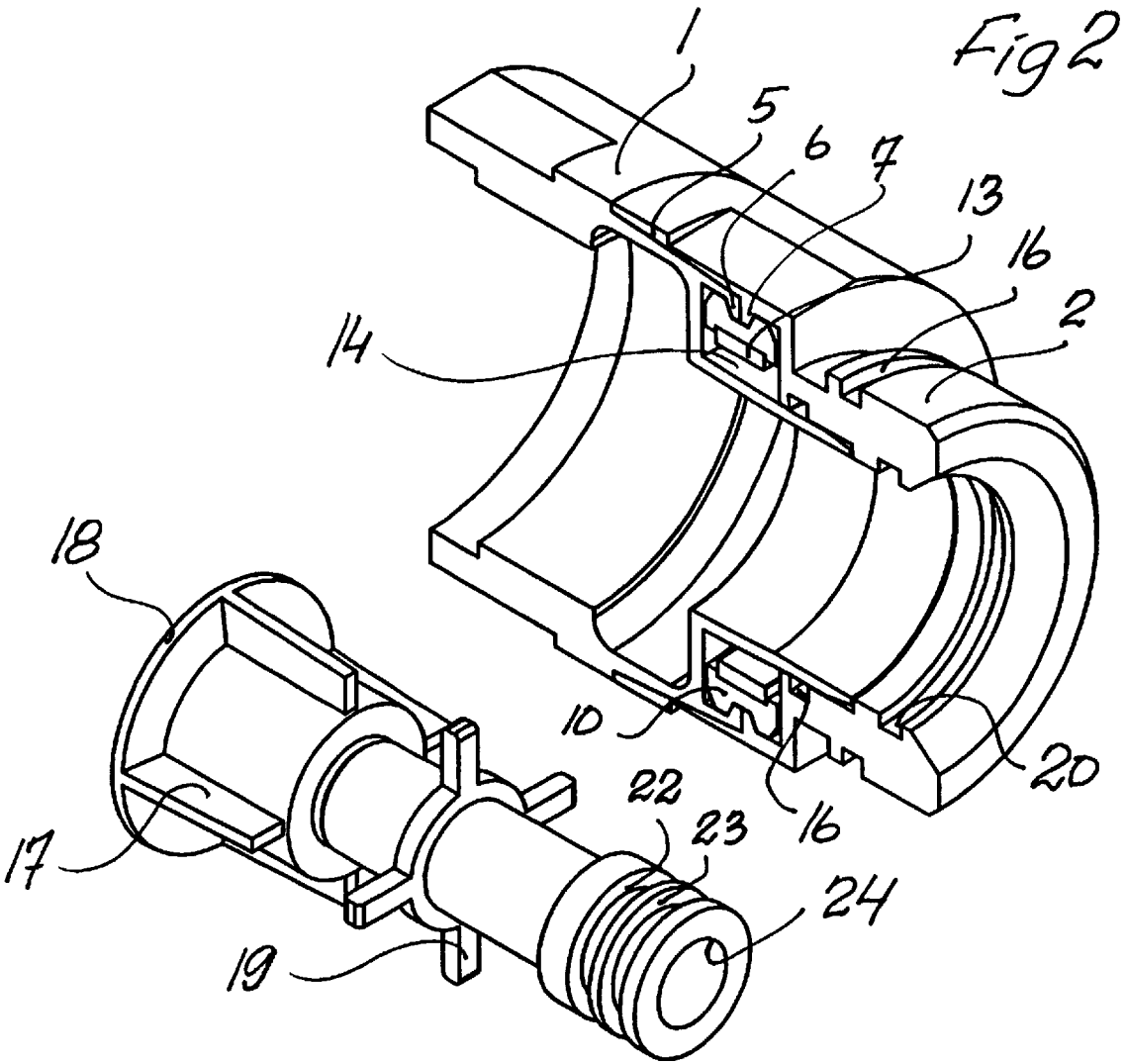
FIG. 2 is a similar perspective view, partly in section, a part having been separated.
Figure 3:
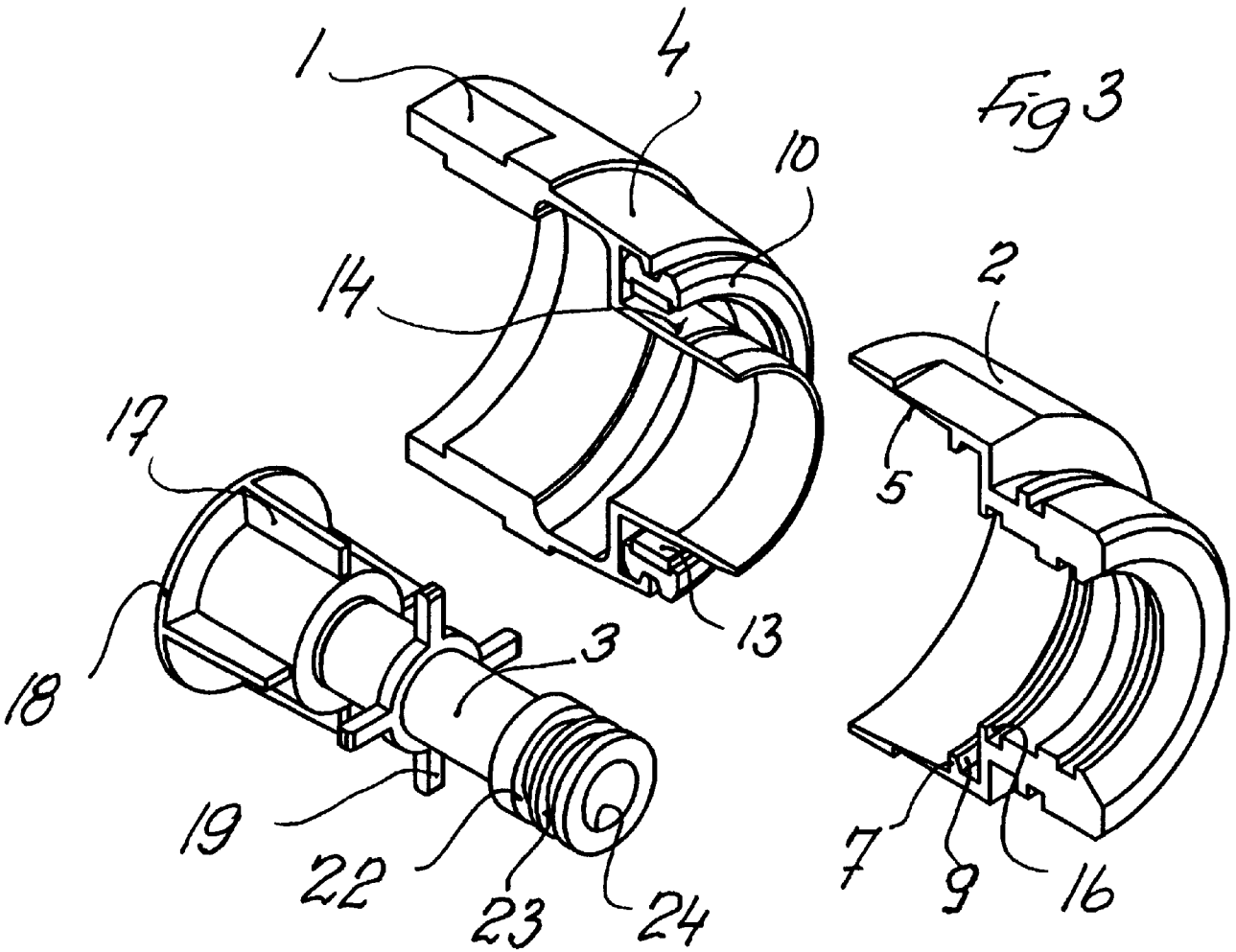
FIG. 3 is a similar perspective view, several parts having been separated from each other.
Figure 4:
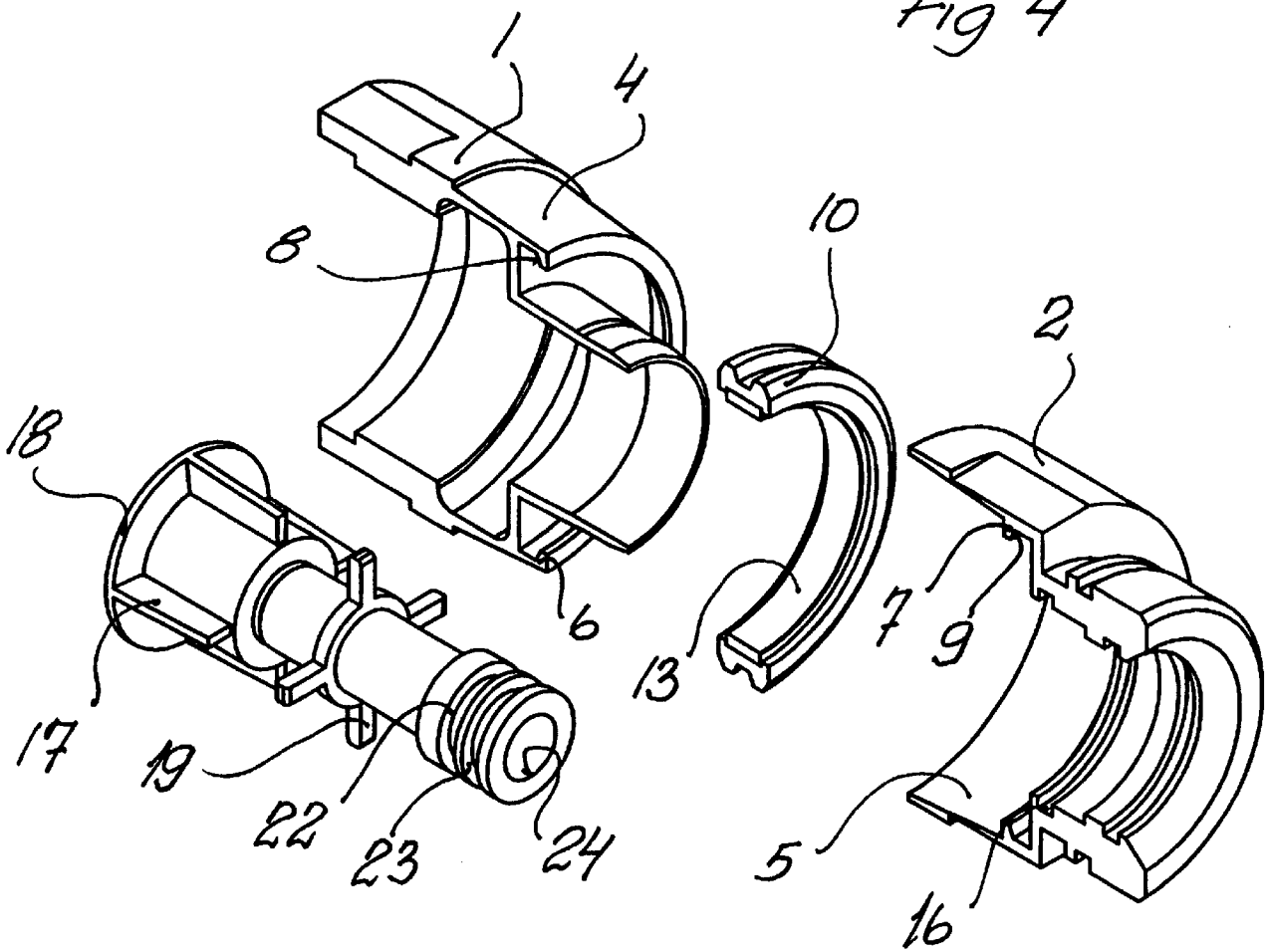
FIG. 4 is a similar perspective view to FIGS. 1–3, with additional parts separated from each other.
Figure 5:
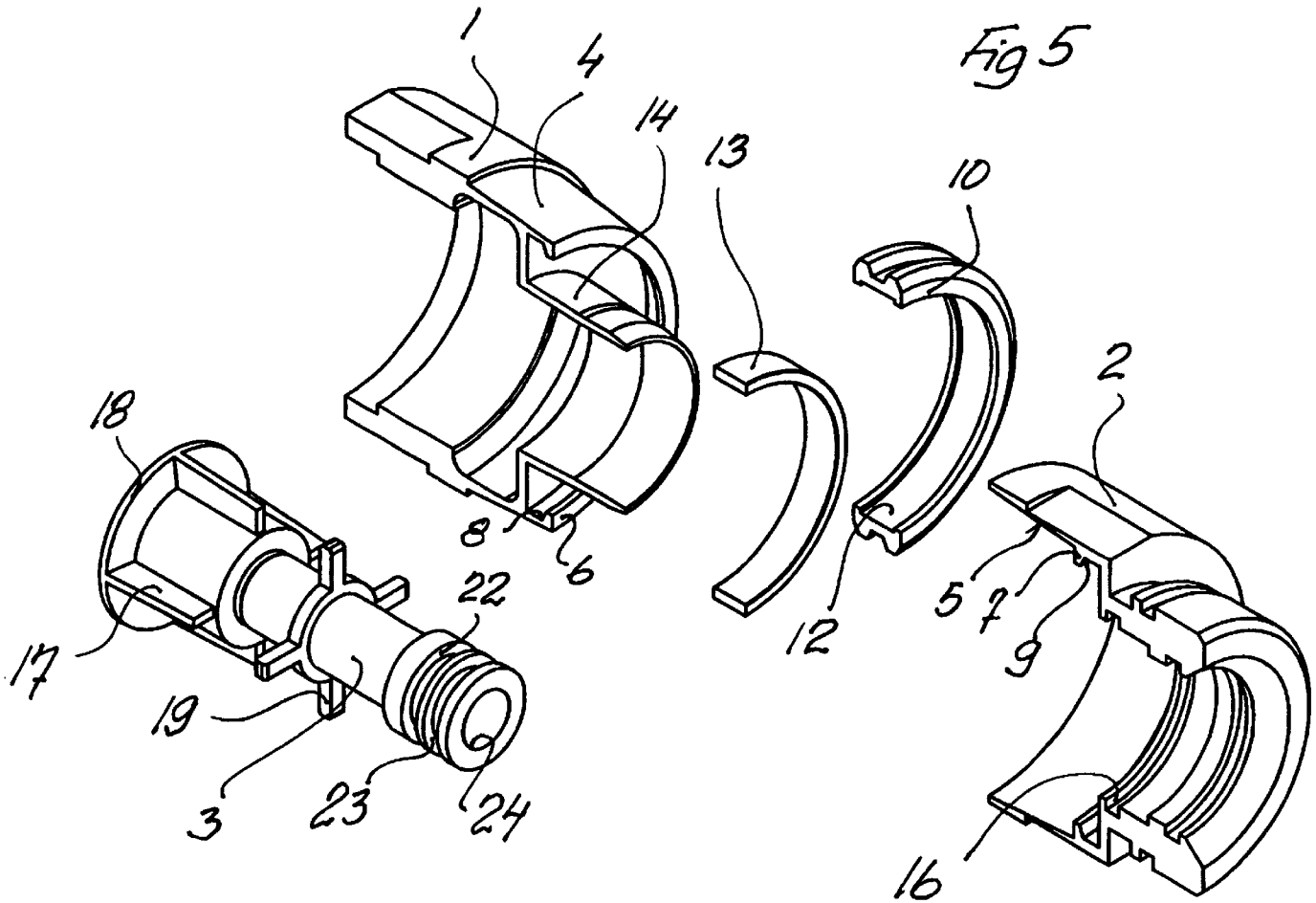
FIG. 5 is yet a further perspective view, substantially similar to FIGS. 1–4, with further parts separated from one another.
Figure 6:
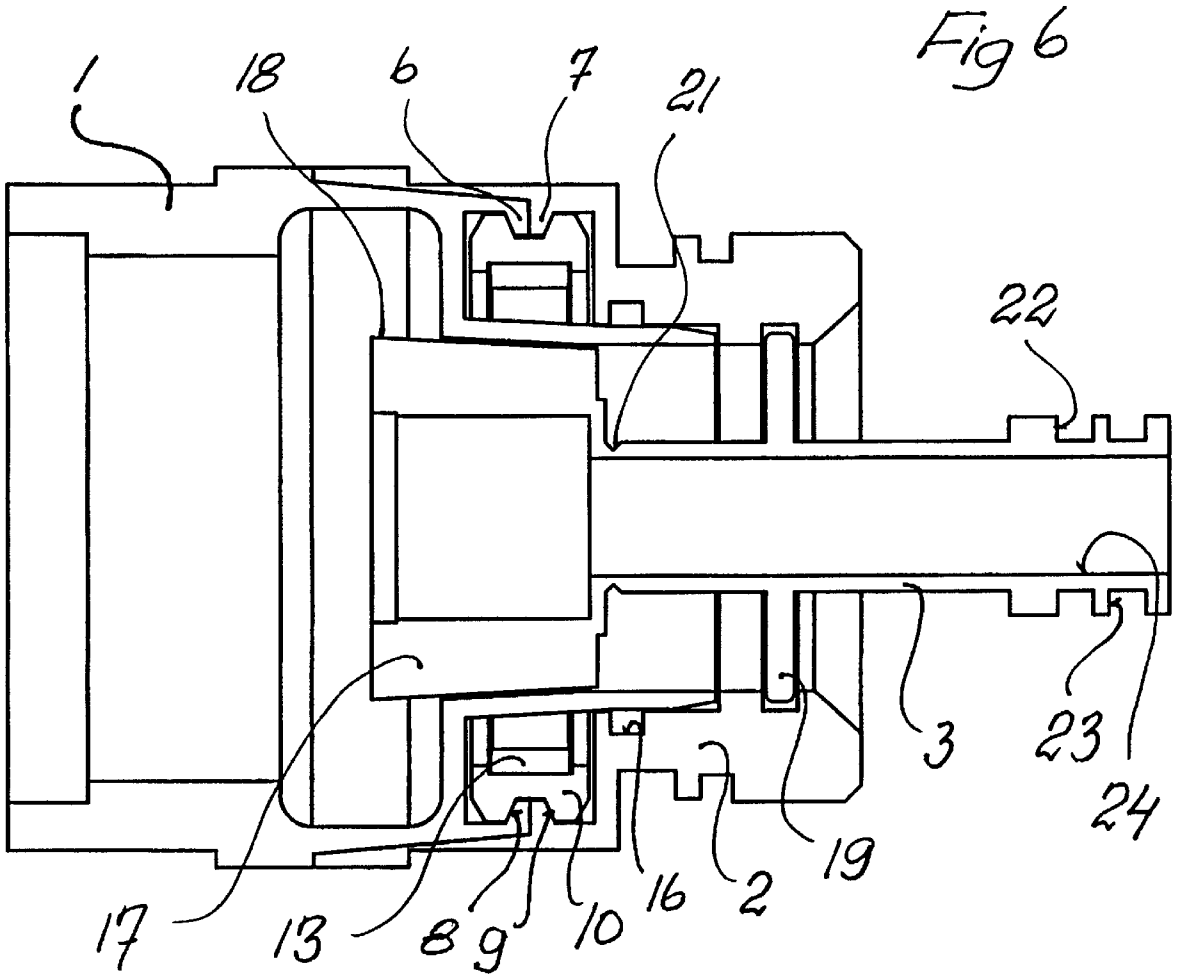
FIG. 6 is a longitudinal section through a device of the same type as shown in FIGS. 1–5.

The embodiment of a device according to the present invention illustrated in FIG. 1 has a male fitting 1, a female fitting 2 and a valve cone 3. The male fitting 1, which may also be designated hose end fitting, is inserted in the female fitting 2, which may also be designated pump nozzle fitting. The fittings 1 and 2 suitably have either external or internal threading for co-operation with a corresponding internal or external thread on the hose end or the pump nozzle, respectively. Between the hose end and the male fitting 1, and the nozzle and the female fitting 2, suitable sealing rings or washers may further be provided. The male fitting 1 has an outer conical surface 4 for co-operation with a substantially similar conical surface 5 in the female fitting 2. The conical surface 4 extends up to a radial projection 6 which is inwardly directed, while the conical surface 5 departs from a radial projection 7. The projections 6 and 7 form a ring with conical surfaces 8 and 9. A ring 10 is split in order to permit contraction of its diameter. The ring 10 has a frusto-conical groove 11 with substantially the same configuration as the projections 6 and 7 with the surfaces 8 and 9. On the inside, the ring 10 has a groove 12 for a spring ring 13 which urges the split ring 10 into engagement with the radial projections 6 and 7.

When a separating force is exercised on the fittings 1 and 2, the ring 10 will show a tendency to contract its diameter against the action of the spring 13 and slide up on the surfaces 8 and 9 until the union of the fittings 1 and 2 ceases and these are parted from each other. Both the male fitting 1 and the female fitting 2 have an inner conical surface 14 and 15, respectively, for co-operation with one another and sealing between the fittings. In order to facilitate the sealing between the fittings, the surface 15 has a groove 16 for a suitable sealing ring, e.g. an X-sealing ring.

The valve cone 3 has a rear portion with axial flanges or fins 17 and a closure edge 18 for co-operation with a corresponding edge on the inside of the male fitting 1. Further, the valve cone 3 has a number of legs 19 for orientation and positioning of the valve cone 3 in the female fitting 2. The legs 19 extend in a groove 20 in the female fitting 2. Moreover, the valve cone 3 has a fracture indication 21. The valve cone 3 further has a front end with sealing grooves 22, 23 for insertion in the pump nozzle.

In the event of a hose rupture, the rupture will be positioned to the coupling consisting of the male fitting 1 and the female fitting 2 in that the ring 10 contracts its diameter against the action of the spring 13 and slides up on the surfaces 8 and 9, so that the male fitting 1 may be withdrawn from the female fitting 2. This will also entail that the valve cone 3 will be divided at the indication of fracture 21 so that the front portion of the valve cone 3 accompanies the female fitting 2 through the engagement of the legs 19 in the groove 20, and the rear portion with the sealing surface 18 comes into contact with a corresponding sealing surface in the male fitting 1 and liquid flow out of the male fitting (which is located on a hose end) is prevented. If the valve cone 3 is intended for vapour recovery, it is provided with a central through-going channel 24 and, in the rear portion, the central channel 24 is provided with a per se conventional non-return valve which closes the channel 24 in the event of a rupture or splitting of the valve cone 3. Otherwise, the rear portion of the valve cone 3 may be solid up to the region of the indication of fracture 21.

In FIGS. 2–10, substantially the same parts have been given the same reference numerals as in FIG. 1.

Figure 7:
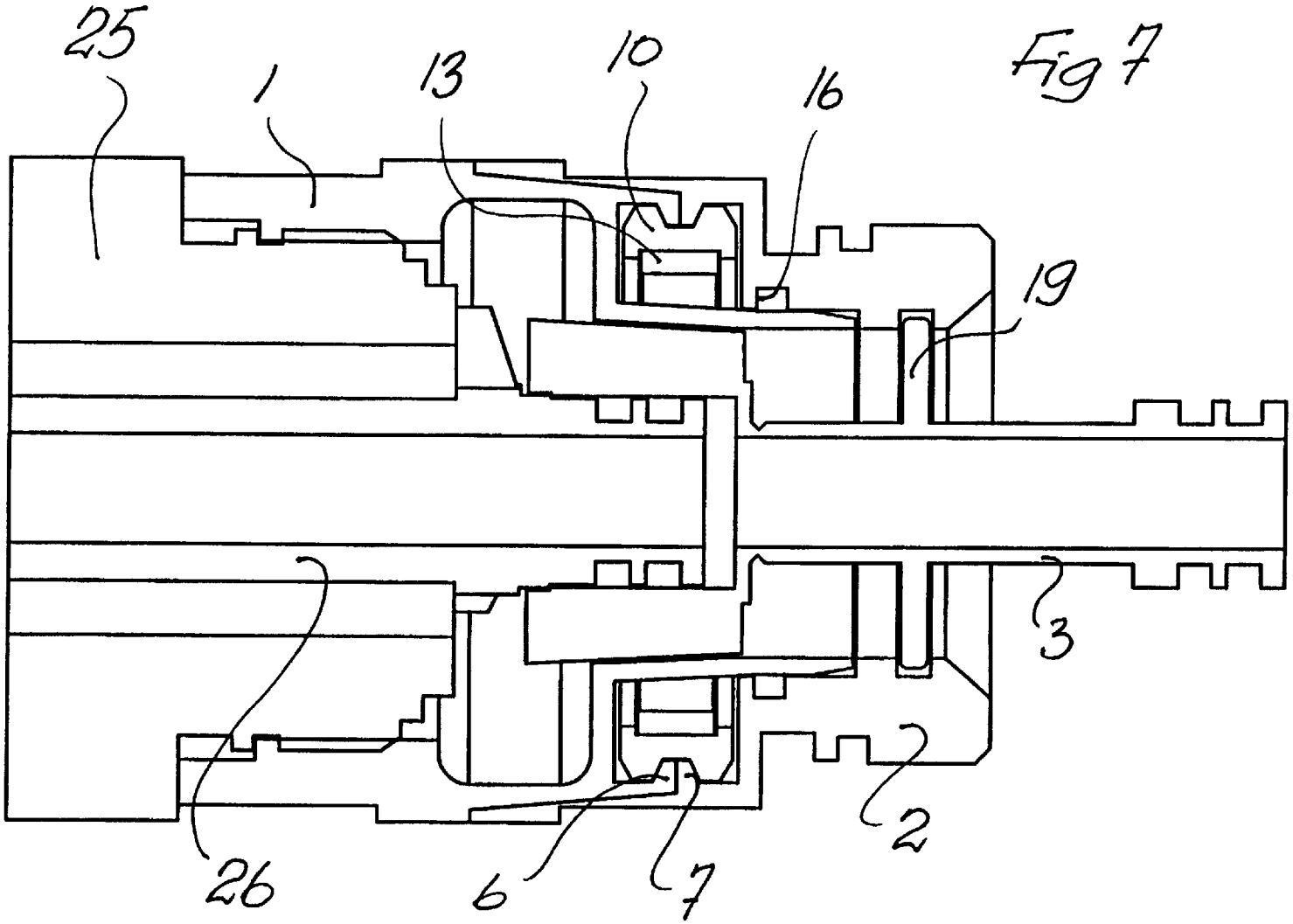
FIG. 7 shows a similar section as FIG. 6 mounted on a hose end.

FIG. 7 shows the device described in the foregoing mounted on a hose end with an outer casing 25 and an inner central channel 26 coaxially disposed therewith for vapour recovery. It will also be apparent how the central channel 26 is interconnected with the valve cone 3.

Figure 8:
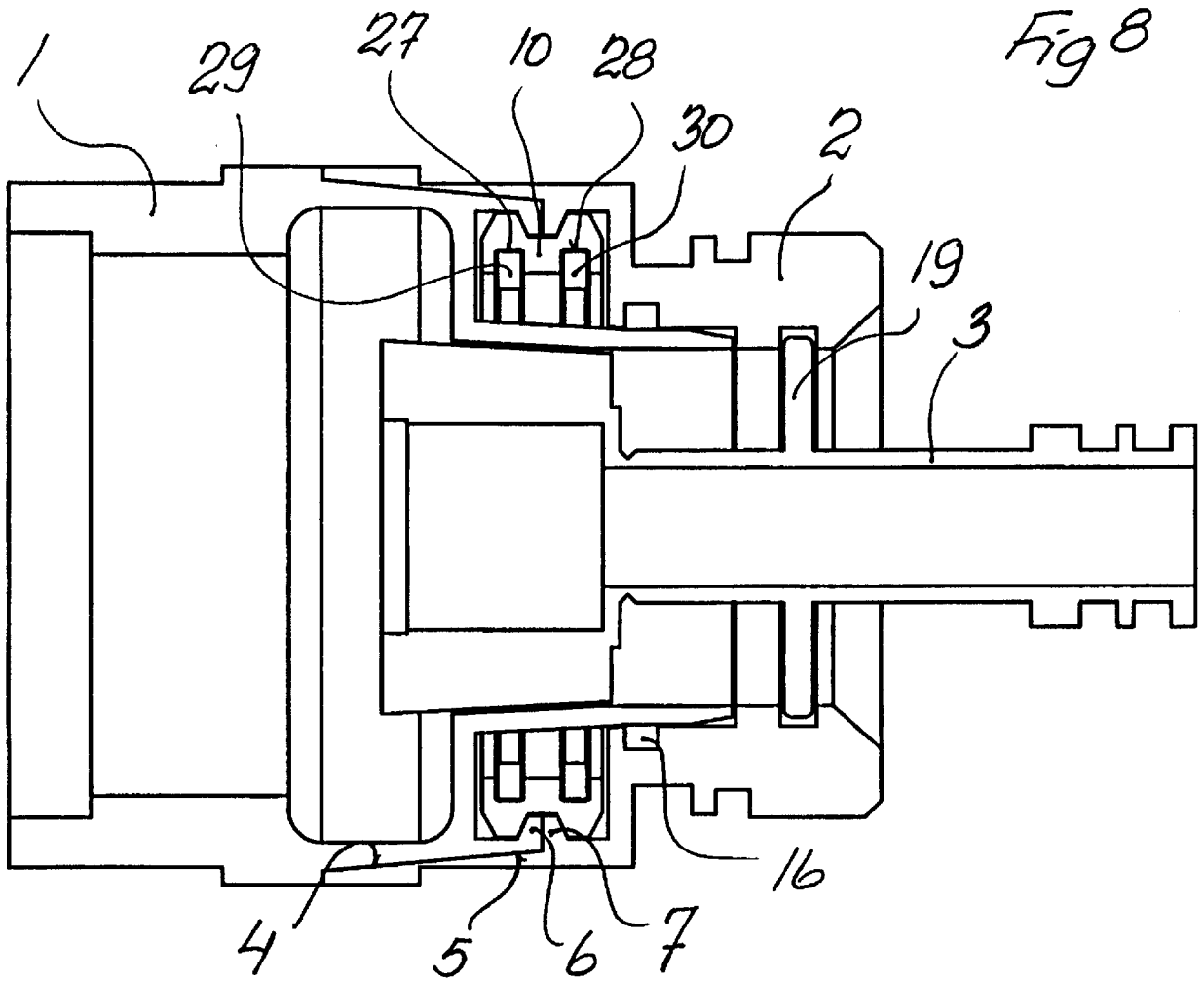
FIG. 8 is a longitudinal section through another embodiment of a device according to the present invention.

FIG. 8 shows another embodiment of a device according to the present invention. The major difference between this embodiment and the embodiment described in the foregoing resides in the fact that the split ring 10 has two grooves 27 and 28 on its inside, each for its spring ring 29, 30.

Figure 9:
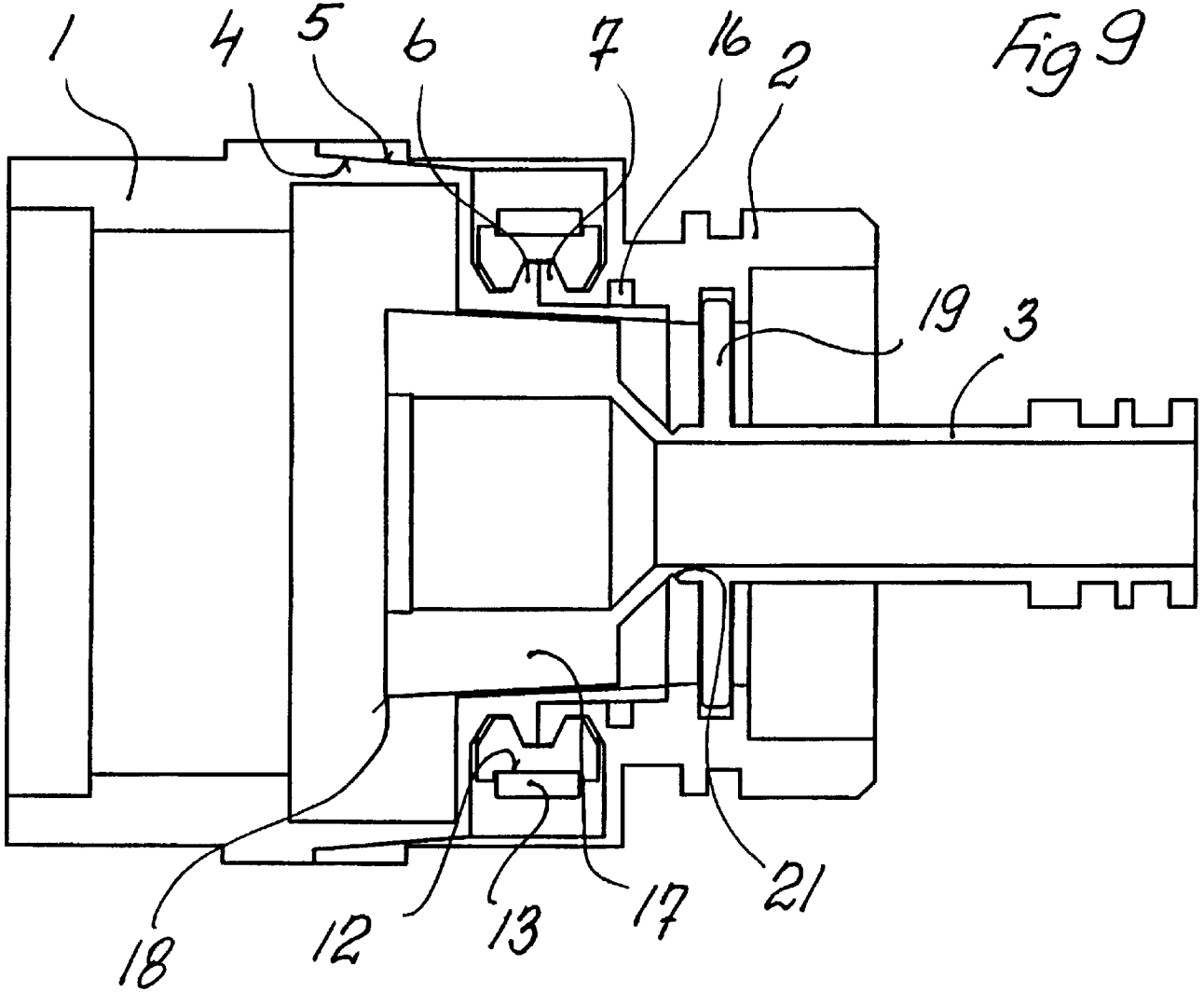
FIG. 9 is a longitudinal section taken through yet a further embodiment of a device according to the present invention.

FIG. 9 shows a further embodiment of a device according to the present invention. The major difference vis-à-vis the two previous embodiments resides in the fact that the radial portions 6 and 7 are outwardly directed instead of inwardly directed and are placed on an inner surface portion of the female fitting and the male fitting instead of an outer surface portion as in the embodiments described in the foregoing. Further, the split ring 10 may be intended to be expanded instead of contracted on the occurrence of separating forces. The spring ring 13 is located on the outside of the ring 10 in a groove 12 disposed on the outside of the ring.

Figure 10:
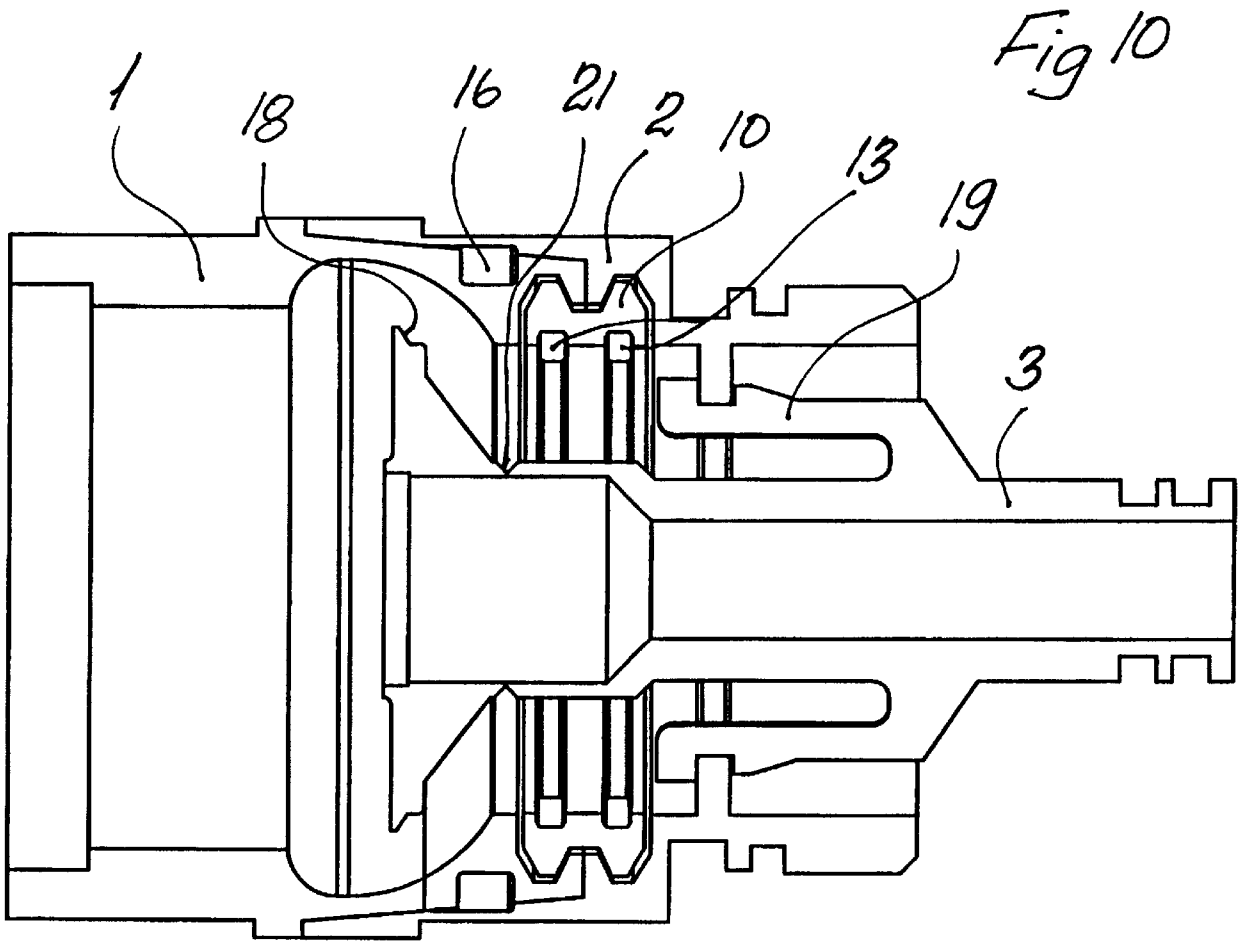
FIG. 10 is a longitudinal section through still a further embodiment of a device according to the present invention.

FIG. 10 shows a further embodiment of a device according to the present invention. This embodiment differs considerably more from the original embodiment than the embodiments illustrated in FIGS. 8 and 9, but corresponding parts carry the same reference numerals in this embodiment as in the other embodiments. Apart from the radial portions 6 and 7 and the placing of the sealing ring groove 16, the valve cone 3 in this embodiment also differs from the earlier embodiments. Thus, both the sealing surface 18 and the fingers 19 are of a different appearance than in the preceding embodiments. In this embodiment, the fingers 19 grasp about a flange instead of extending in a groove.

It should also be observed that the split ring 10 may very well be divided into several parts or segments, preferably two, three or four.

The embodiment in FIG. 9 may also have several spring rings instead of the illustrated single spring ring 13.

Figure 11:
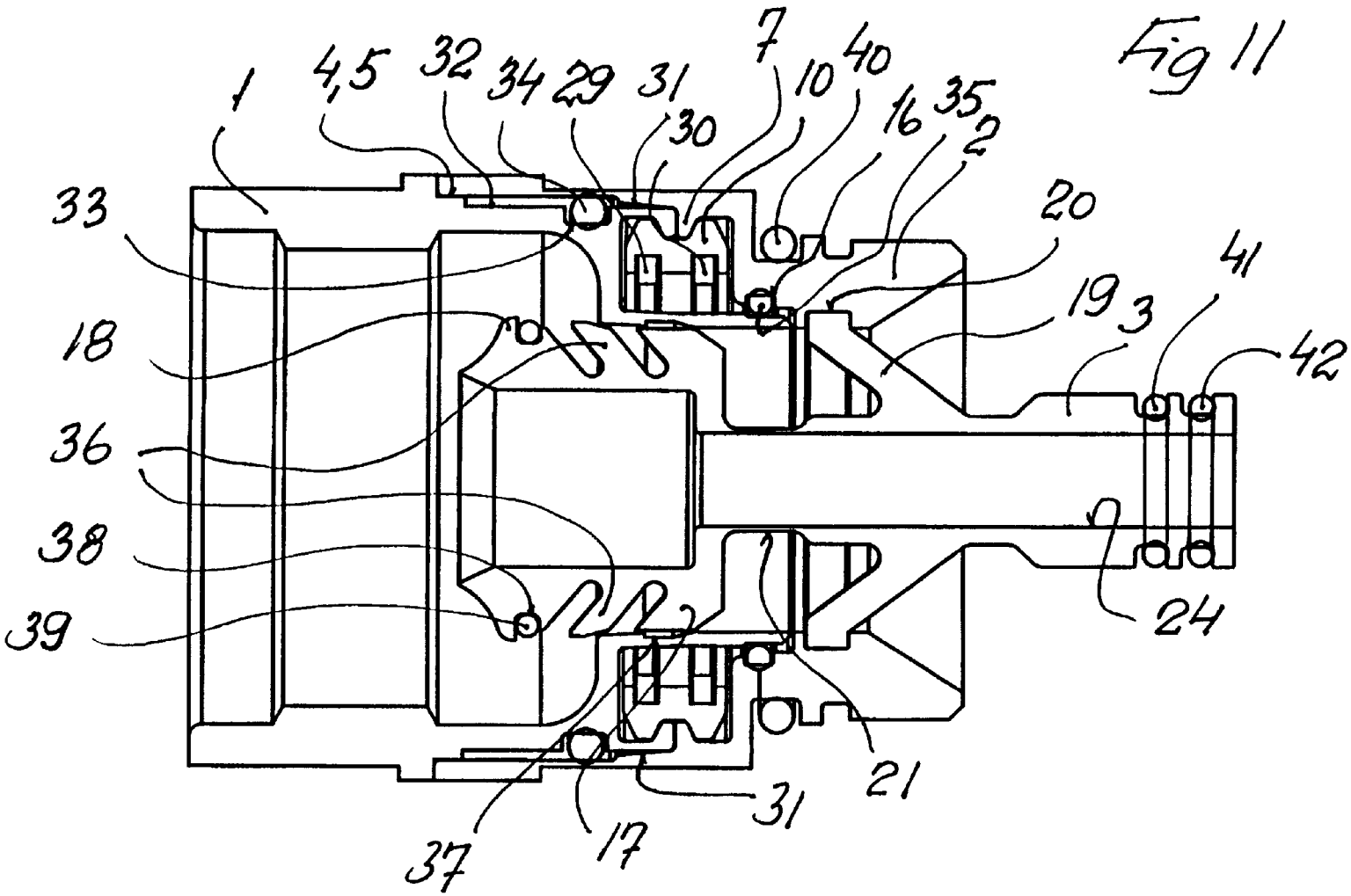
FIG. 11 is a longitudinal section through yet a further embodiment of a device according to the present invention.

The embodiment of a device according to the present invention illustrated in FIG. 11 differs from the embodiments shown in the preceding Drawings substantially in that the outer conical surface 4 is a short cylindrical surface 4 for co-operation with a cylindrical surface 5 in the female fitting 2, whereafter the surface 4 reduces to a surface of lesser diameter. The surface 5 in the female fitting 2 merges in a conical surface portion 31 a distance ahead of the radial projection 7. There is thus formed between the surfaces 4, 5 and 31, a space 32 which permits movement between the male fitting 1 and the female fitting 2. The surface of lesser diameter has a groove 33 for a sealing ring 34. A sealing ring 35 is shown in the groove 16. In this embodiment, the ring 10 is in a part which is urged out towards the radial projections 6 and 7 by means of the spring rings 29 and 30.

In this embodiment, the valve cone 3 has an indication of fracture 21 which is in the form of a waist of considerable extent in the longitudinal direction of the valve cone 3. The fingers 19 on the valve cone 3 extend at an angle to the longitudinal axis and the ends of the fingers 19 extend into the grooves 20 in the female fitting 2. The axial flanges or fins 17 on the rear portion of the valve cone 3 display a pair of obliquely extending, radial grooves for forming a finger 36 whose outer end extends somewhat outside the flanges or fins 17 for engagement in a groove 37 on the inside of the forward portion of the male fitting 1. The fingers 36 enter into engagement with the groove 37 only after a hose rupture, when the valve cone is drawn into the male fitting before a fracture occurs in the indication of fracture 21, whereafter the remaining portion of the valve cone 3 is in principle fixed in the male fitting 1 by the engagement of the fingers 36 in the groove 37.

The rear portion of the valve cone 3 has, in this embodiment, a groove 38 for a sealing ring 39, for ensuring sealing against the edge in the male fitting 1. FIG. 11 further shows a number of sealing rings 40, 41 and 42 for ensuring sealing in a pump nozzle.

The engagement of the fingers 36 in the groove 37 also has for its purpose to prevent, to as great an extent as possible, re-use of the device after the rupture situation. After a rupture, it is extremely difficult—if not impossible—to remove the rear portion of the valve cone 3 from the male fitting 1 without these parts being destroyed.

Figure 13:
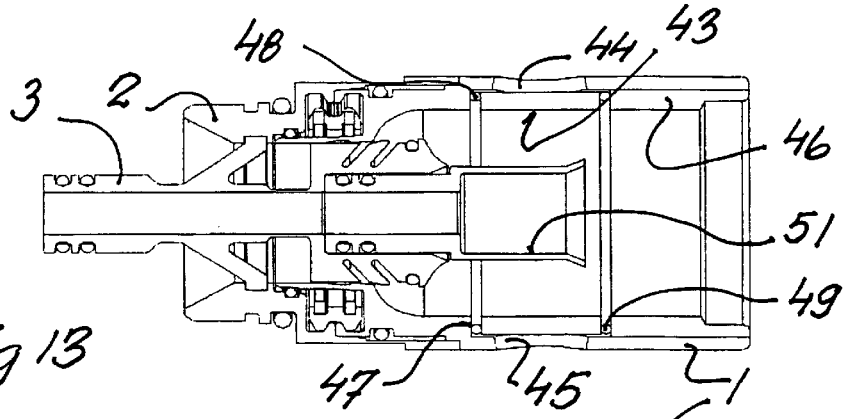
FIG. 13 is a longitudinal section through yet a further variation of the embodiment of a device according to the present invention illustrated in FIG. 11.
Figure 14:
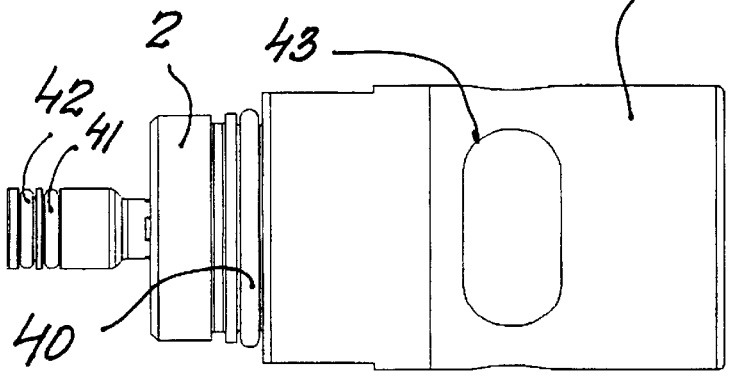
FIG. 14 is a view of the embodiment of a device according to the present invention illustrated in FIG. 13.
Figure 15:
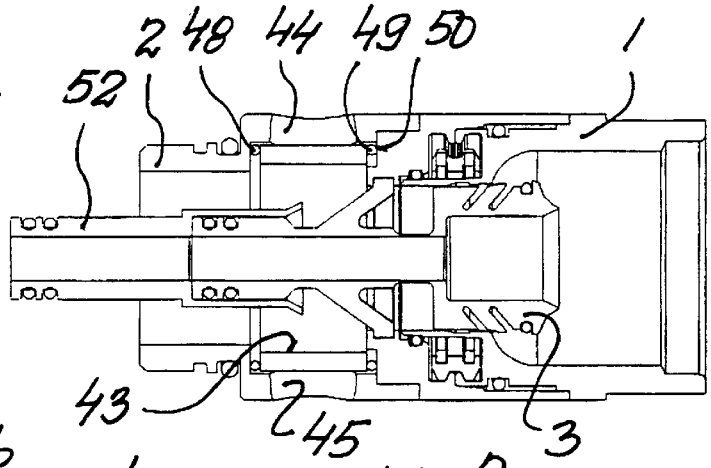
FIG. 15 is a longitudinal section through a male and female fitting in the embodiment of a device according to the present invention illustrated in FIG. 11, while a view of a cone is shown.
Figure 16:
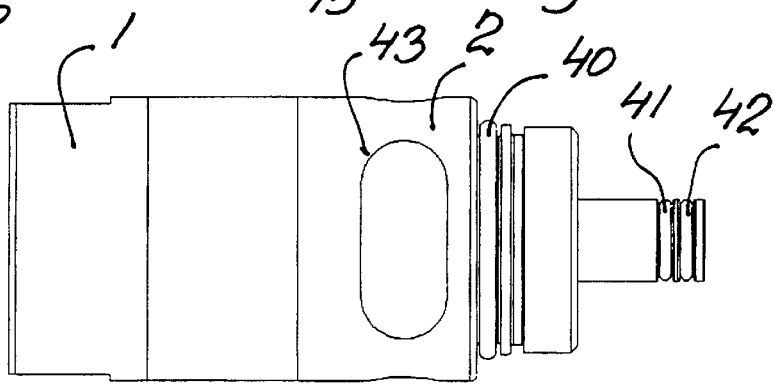
FIG. 16 is a view of the embodiment of a device according to the present invention illustrated in FIG. 15.

The variations illustrated in FIGS. 13–16 of the embodiment of a device according to the present invention illustrated in FIG. 11 differ therefrom substantially by the provision of a spyglass 43 which, in the variation according to FIGS. 13 and 14, is located in the male fitting 1, and in the variation according to FIGS. 15 and 16, is disposed in the female fitting 2.

In the variation according to FIGS. 13 and 14, the male fitting 1 is extended and displays two recesses 44 and 45 which are located substantially in register with one another and which are covered by means of a tubular spyglass 43 which is in the form of a transparent tube section. The spyglass 43 is kept in place in the male fitting 1 by means of an inner male fitting 46 which may be threaded in the outer male fitting 1 for urging the spyglass section 43 against a surface 47 in the male fitting 1 by the intermediary of two sealing rings 48 and 49.

In the variation illustrated in FIGS. 15 and 16, the spyglass 43 is, as was mentioned above, disposed in the female fitting 2 which is divided into an outer portion and an inner portion, the outer portion having the recesses 44 and 45 and preferably being fixedly threaded in the inner portion while the spyglass 43 is urged against a surface 50 on the inner portion by the intermediary of sealing rings 48 and 49.

In both of the spyglass variations, it is necessary to extend the valve cone 3. In the variation according to FIGS. 13 and 14, the valve cone 3 is extended by means of a rear portion 51, while the valve cone 3 in the variation according to FIGS. 15 and 16 is extended by means of a forward portion 52.

Figure 12:
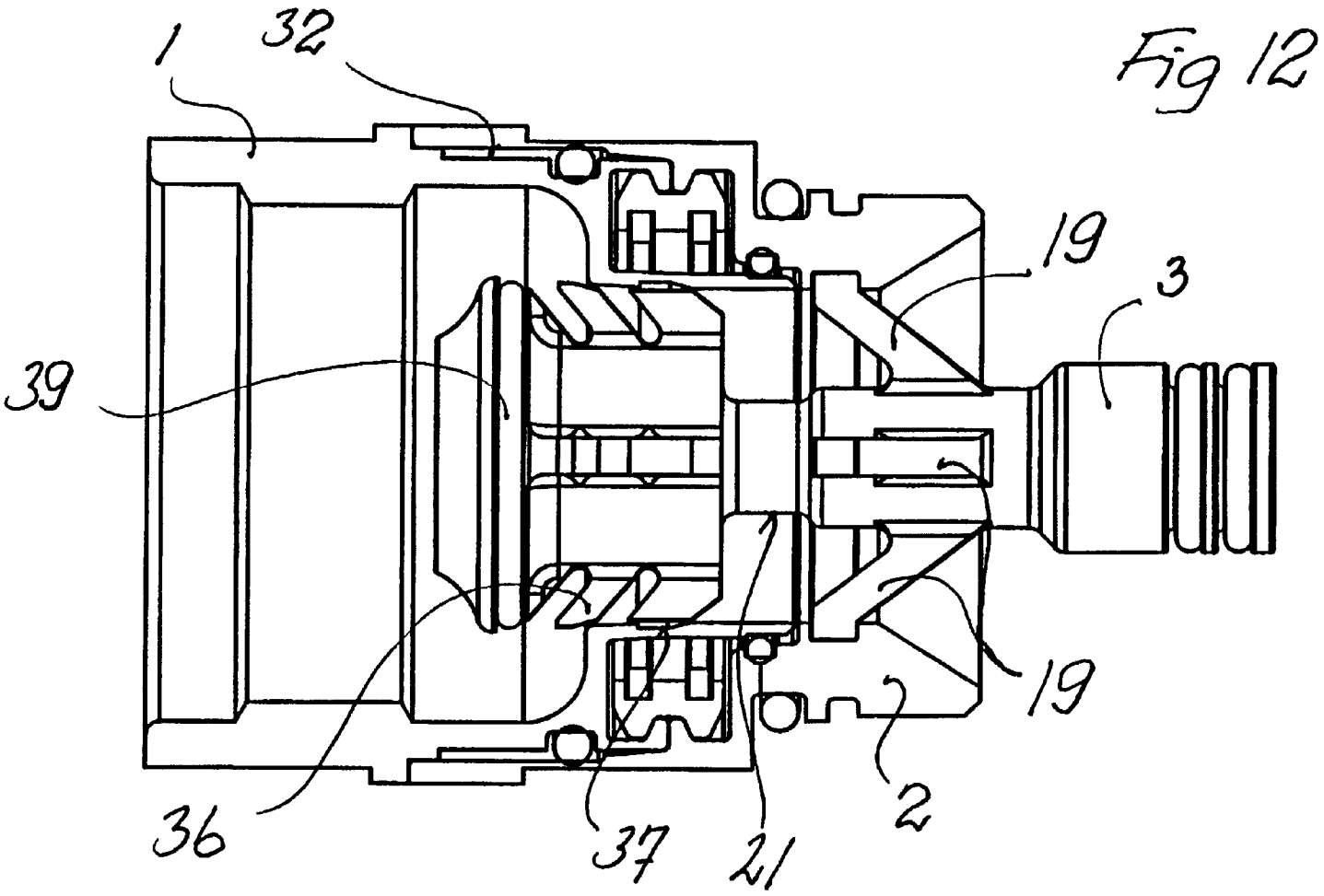
FIG. 12 is a longitudinal section through a variation of the embodiment of a device according to the present invention illustrated in FIG. 11.
Figure 17:
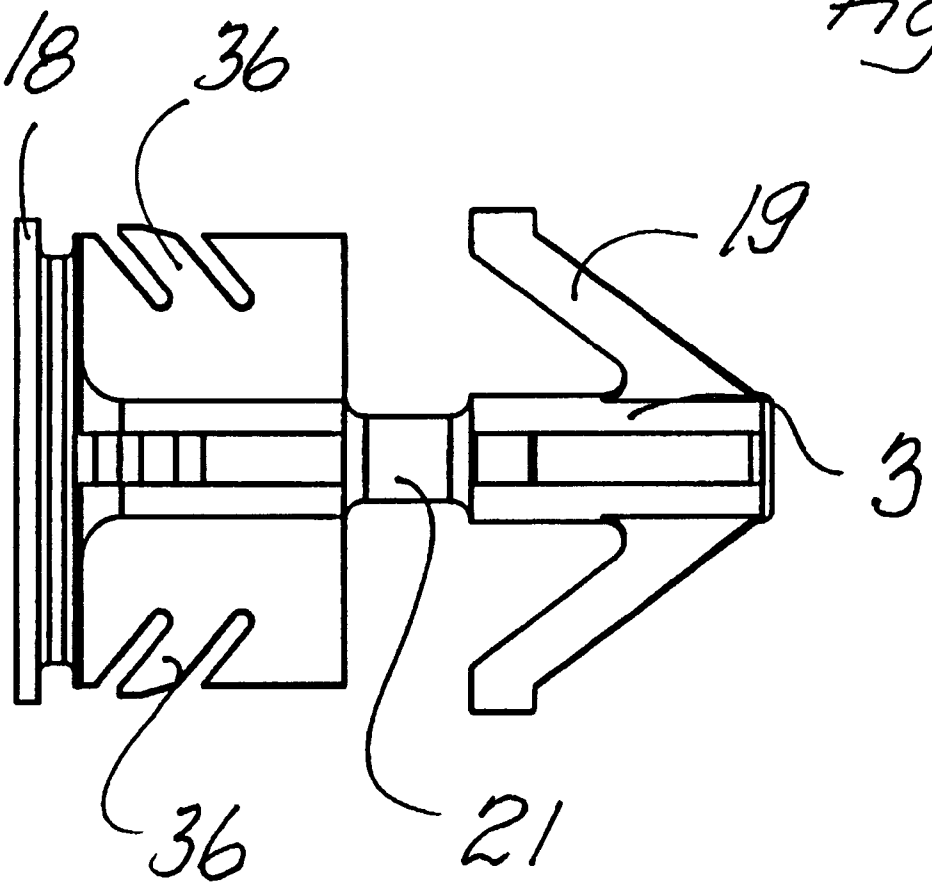
FIG. 17 is a view of a cone for a device according to the present invention without vapour recovery.

FIG. 17 shows a valve cone 3 for replacing the valve cone in the embodiment in FIGS. 11 and 12 on adaptation of the device according to the present invention for employment in stations without vapour recovery.

Many modifications are conceivable without departing from the inventive concept as this is defined in the appended claims.

What is claimed is:

1. A device for blocking a liquid- and/or vapour flow from a hose and positioning a hose rupture to a coupling in the hose, the coupling comprising a female fitting (2) and a male fitting (1), each with its radial, at least partly conical portion (6, 7) which, after union of the male fitting (1) in the female fitting (2), forms at least parts of a conical ring, and a split ring (10) consisting of one or more parts and provided with a groove (11) fitting the conical ring, being disposed on the conical ring (6, 7) for interconnecting and retaining the male fitting (1) in the female fitting (2), characterised in that the ring (10), on the opposite side in relation to the groove (11), has at least one groove (12, 27, 28) for a spring ring (13, 29, 30) for orientation of the spring ring (13, 29, 30) and urging said ring (10) against the conical ring (6, 7) and retention of the male fitting (1) in the female fitting (2) until a predetermined separating force occurs, when the split ring (10) slides off the conical ring (6, 7) so that the retention of the male fitting (1) in the female fitting (2) ceases; that a valve cone (3) is disposed to block liquid- and/or vapour flow in the event that the male fitting (1) and the female fitting (2) are parted from one another; and that the valve cone (3) has coupling elements (19) for engagement with the female fitting (2), and a sealing element (18) for co-operation with a sealing surface in the male fitting (1), or vice versa, and that an indication of fracture (21) is located between the coupling elements (19) and the sealing element (18).

2. The device as claimed in claim 1, characterised in that the split ring (10) consists of one part and is progressively deformable in correspondence to a separating force until it has been opened or closed so that the conical ring (10) is free and the male fitting (1) is drawn out of the female fitting (2).

3. The device as claimed in claim 1, characterised in that the radial, at least partly conical portions (6, 7) are inwardly directed; and that the groove (11) in the split ring (10) is located on the outside of the ring (10); and that the spring ring or spring rings (13) are located on the inside of the ring (10) for expanding the diameter of the ring (10) into engagement with the radial portions (6, 7).

4. The device as claimed in claim 1, characterised in that the radial, at least partly conical portions (6, 7) are outwardly directed; and that the groove (11) in the split ring (10) is located on the inside of the ring (10); and that the spring ring or spring rings (13) are located on the outside of the ring (10) for contracting the diameter of the ring (10) into engagement with the radial portions (6, 7).

5. The device as claimed in claim 1, characterised in that a sealing ring groove (16) is disposed in an inner surface portion of the female fitting (2) for urging a sealing ring, against an outer surface portion of the male fitting (1).

6. The device as claimed in claim 1, characterised in that the male fitting (1) has a cylindrical surface portion (4) for co-operation with a cylindrical surface portion (5) in the female fitting (2) and a cylindrical surface portion of lesser diameter than the co-operation portion (4) for forming a space (32) for permitting movement between the male fitting (1) and the female fitting (2).

7. The device as claimed in claim 6, characterised in that the cylindrical surface portion (5) in the female fitting (2) has an inner conical surface portion (31).

8. The device as claimed in claim 6, characterised in that the male fitting (1) has an inwardly directed groove (37) for co-operation with a number of fingers (36) on a rear portion of the valve cone (3).

9. The device as claimed in claim 6, characterised in that a number of positioning fingers on a forward portion of the valve cone (3) extend at an angle to the longitudinal axis of the valve cone (3) and engage with a groove (20) in the female fitting (2).

* * * * *